US009941591B2

(12) United States Patent
Lilja

(10) Patent No.: US 9,941,591 B2
(45) Date of Patent: Apr. 10, 2018

(54) ANTENNA ARRANGEMENT

(71) Applicant: MICROSOFT TECHNOLOGY LICENSING, LLC, Redmond, WA (US)

(72) Inventor: Juha Lilja, Tampere (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 85 days.

(21) Appl. No.: 15/060,594

(22) Filed: Mar. 3, 2016

(65) Prior Publication Data

US 2017/0256856 A1 Sep. 7, 2017

(51) Int. Cl.

| | |
|---|---|
| ***H01Q 1/24*** | (2006.01) |
| ***H01Q 7/06*** | (2006.01) |
| ***H01Q 7/00*** | (2006.01) |
| ***H01Q 1/38*** | (2006.01) |
| ***H01Q 1/12*** | (2006.01) |
| ***H01Q 1/22*** | (2006.01) |

(52) U.S. Cl.

CPC ..... *H01Q 7/06* (2013.01); *H01Q 1/1207* (2013.01); *H01Q 1/22* (2013.01); *H01Q 1/38* (2013.01); *H01Q 7/00* (2013.01)

(58) Field of Classification Search

CPC .. H01Q 1/38; H01Q 1/24; H01Q 7/00; H01Q 7/08

See application file for complete search history.

(56) References Cited

U.S. PATENT DOCUMENTS

| | | | |
|---|---|---|---|
| 7,782,610 | B2 | 8/2010 | Diebel et al. |
| 8,487,479 | B2 | 7/2013 | Cook et al. |
| 8,995,910 | B2 | 3/2015 | Chong et al. |
| 9,105,967 | B2 | 8/2015 | Park |
| 9,112,272 | B2 * | 8/2015 | Finn ..... G06K 19/07769 |
| 9,112,364 | B2 | 8/2015 | Partovi |
| 2010/0309081 | A1 | 12/2010 | Kobayashi et al. |
| 2013/0260677 | A1 | 10/2013 | Partovi |
| 2013/0271069 | A1 | 10/2013 | Partovi |
| 2014/0375262 | A1 | 12/2014 | Yamaguchi et al. |
| 2015/0054692 | A1 | 2/2015 | Choi et al. |

(Continued)

FOREIGN PATENT DOCUMENTS

| | | | |
|---|---|---|---|
| KR | 20140120671 | A | 10/2014 |
| WO | 2013014958 | A1 | 1/2013 |
| WO | 2015007951 | A1 | 1/2015 |

OTHER PUBLICATIONS

Jugieu, et al., "Design and Simulation of Printed Winding Inductors for Inductive Wireless Power Charging Applications", in Proceedings of IEEE Wireless Power Transfer Conference, May 13, 2015, 4 pages.

(Continued)

*Primary Examiner* — Hoang Nguyen

(57) ABSTRACT

An antenna arrangement comprises a casing comprising a flange and a collar extending upwards from the flange. A magnetic loop antenna coil covers an outer surface of at least one of the flange and the collar at least partly. A magnetic material layer is arranged between the magnetic loop antenna coil and the outer surface of the flange and the collar to guide the magnetic flux generated by the magnetic loop antenna coil, the magnetic material layer covering both the flange and the collar at least partly.

20 Claims, 8 Drawing Sheets

(56) References Cited

U.S. PATENT DOCUMENTS

| | | | |
|---|---|---|---|
| 2015/0123604 | A1 | 5/2015 | Lee et al. |
| 2015/0214993 | A1 | 7/2015 | Huang |

OTHER PUBLICATIONS

Litchfield, Steve, "The Noisy Mystery of Qi Charging Circuitry—Solved!", Published on: Nov. 21, 2014, 13 pages, Available at: http://allaboutwindowsphone.com/features/item/20276_the_noisy_mystery_of_nokias_re.php.

Han, et al., "Dual-mode Wireless Power Transfer Module for Smartphone Application", in Proceedings of IEEE International Symposium on Antennas and Propagation & USNC/URSI National Radio Science Meeting, Jul. 19, 2015, pp. 111-112.

Pinto, et al., "Exposure Assessment of Stray Electromagnetic Fields Generated by a Wireless Power Transfer System", In Proceedings of 9th European Conference on Antennas and Propagation, Jul. 13, 2015, 4 pages.

"International Search Report and Written Opinion Issued in PCT Application No. PCT/US2017/019320", dated Jun. 20, 2017, 11 Pages.

* cited by examiner

ANTENNA ARRANGEMENT

BACKGROUND

Loop antennas, for example, magnetic loop antennas are used in mobile devices to provide connectivity to external devices. A magnetic loop antenna may enable wireless charging capabilities for a mobile device. Similarly, a magnetic loop antenna may enable Near Field Communication (NFC) capabilities for the mobile device. The magnetic loop antenna needs to be placed inside the mobile device and it requires a certain amount of space. For example, the thickness of the loop antenna may be 1 mm. If the total thickness of the mobile device is, for example, around 6-8 mm, the loop antenna significantly contributes to the total thickness of the mobile device.

SUMMARY

This Summary is provided to introduce a selection of concepts in a simplified form that are further described below in the Detailed Description. This summary is not intended to identify key features or essential features of the claimed subject matter, nor is it intended to be used to limit the scope of the claimed subject matter.

According to an aspect, there is provided an antenna arrangement. The antenna arrangement comprises a casing comprising a flange and a collar extending upwards from the flange, a magnetic loop antenna coil covering an outer surface of at least one of the flange and the collar at least partly, and a magnetic material layer between the magnetic loop antenna coil and the outer surface of the flange and the collar to guide the magnetic flux generated by the magnetic loop antenna coil, the magnetic material layer covering both the flange and the collar at least partly.

According to another aspect, there is provided an antenna arrangement. The antenna arrangement comprises a casing comprising collar extending upwards, a magnetic loop antenna coil covering an outer surface of the collar at least partly, and a magnetic material layer between the magnetic loop antenna coil and the outer surface of the collar to guide the magnetic flux generated by the magnetic loop antenna coil.

According to another aspect, there is provided a mobile apparatus. The mobile apparatus comprises a metallic back cover comprising an opening, a mobile apparatus component casing comprising a flange and a collar extending upwards from the flange towards the metallic back cover, a magnetic loop antenna coil covering an outer surface of at least one of the flange and the collar at least partly, and a magnetic material layer between the magnetic loop antenna coil and the outer surface of the flange and the collar to guide the magnetic flux generated by the magnetic loop antenna coil towards the opening, the magnetic material layer covering both the collar and the flange at least partly.

Many of the attendant features will be more readily appreciated as they become better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. However, the same or equivalent functions and sequences may be accomplished by different examples.

Figure 1A:
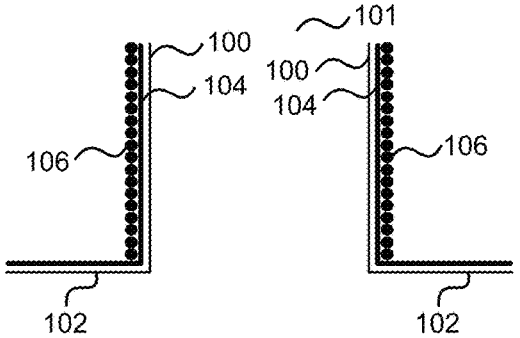
FIG. 1A illustrates an antenna arrangement in accordance with one embodiment.

FIG. 1A illustrates an antenna arrangement in accordance with one embodiment. The antenna arrangement comprises a casing 101 comprising a flange 102 and a collar 100 extending upwards from the flange 102. Although in FIG. 1A the collar 100 extends vertically upwards from the flange 102, in other embodiments, the angle between the flange 102 and the collar may be different than 90 degrees. For simplicity, FIG. 1A may not illustrate all parts or surfaces belonging to the casing 101, for example, a top surface.

The casing 101 may be a mechanical holder of an existing element in a mobile device. For example, the casing 101 may be a camera holder surrounding a camera. In another embodiment, the casing 101 may be a supporting element for a fingerprint reader or a flash module.

In FIG. 1A, a magnetic material layer 104 has been arranged to completely cover an outer surface of the flange 102 and the collar 100. The magnetic material layer 104 may be applied on the flange 102 and the collar 100 using any appropriate technique, for example, gluing, molding, casting, painting etc. Further, although FIG. 1A may illustrate that the magnetic material layer 104 resides on the outer surface of the flange 102 and the collar 100, in another embodiment the magnetic material layer may not be in direct contact with the outer surface of the flange 102 and the collar 100.

The antenna arrangement comprises also a magnetic loop antenna coil 106 or a loop antenna coil covering the collar 100 so that the magnetic material layer 104 is between the magnetic loop antenna coil 106 and the outer surface of the collar 100. In one embodiment, the magnetic loop antenna coil 106 is wrapped around the collar 100. The number of rounds of the magnetic loop antenna coil 106 around the collar 100 may depend on the purpose of use of the antenna arrangement and the frequency range provided by the antenna. Although not illustrated in FIG. 1A, the magnetic loop antenna coil 106 may have connection ends to connect the magnetic loop antenna coil 106, for example, to a matching circuit.

The magnetic material layer 104 may comprise ferrite. It is also possible to use any other material than ferrite as long as the material favorably aligns the magnetic flux provided by the magnetic loop antenna coil 106 and shields possible metal parts of the casing 101 from the magnetic field of the antenna.

The casing 101 may be made of electrically conductive or non-conductive material.

The electrical characteristics of the antenna are defined by the application. For example, if the antenna is used for wireless charging, the inductance of the antenna is typically within a range 10-20 μH and the frequency within a range 100-200 kHz. If the antenna is used for Near Field Communication (NFC), the inductance of the antenna is typically within a range 1-2 μH and the frequency approximately 13.56 MHz. If the antenna is used for frequency modulation/amplitude modulation (FM/AM) radio, the antenna's resonance frequency is approximately 100 MHz.

When the magnetic material layer 104 is used between the magnetic loop antenna coil 106 and the outer surface of the casing 101, eddy currents deteriorating the performance of the antenna are prevented. Further, when integrating the magnetic loop antenna coil with an already existing element in the mobile device, the antenna arrangement does not cause any additional increase in the thickness of the mobile device.

Figure 1B:
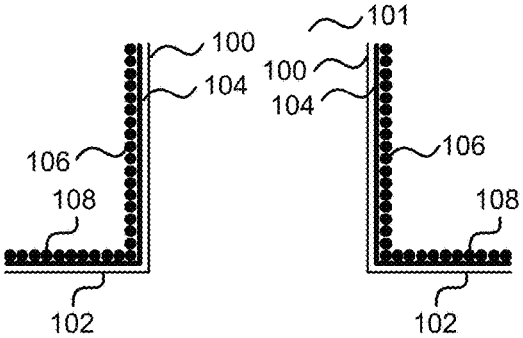
FIG. 1B illustrates an antenna arrangement in accordance with another embodiment.

FIG. 1B illustrates an antenna arrangement in accordance with another embodiment. The antenna arrangement illustrated in FIG. 1B differs from the antenna arrangement illustrated in FIG. 1A in that the magnetic loop antenna coil 106 extends 108 to cover also the flange 102 of the casing 101.

Figure 1C:
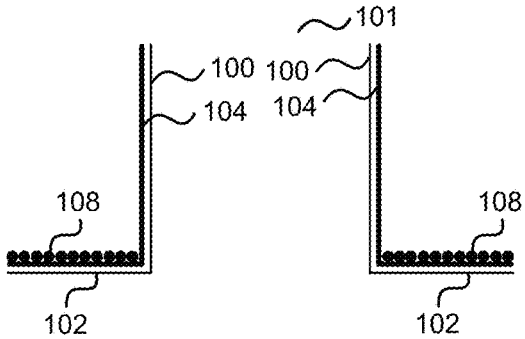
FIG. 1C illustrates an antenna arrangement in accordance with another embodiment.

FIG. 1C illustrates an antenna arrangement in accordance with another embodiment. The antenna arrangement illustrated in FIG. 1C differs from the antenna arrangement illustrated in FIG. 1A in that the magnetic loop antenna coil 108 covers only the flange 102 of the casing 101. Although there is no magnetic antenna coil covering the collar 100, the magnetic material layer 104 still exists to cover the collar 100 of the casing 101. The magnetic material layer 104 directs the magnetic field produced by the magnetic loop antenna coil 108 upwards.

Figure 1D:
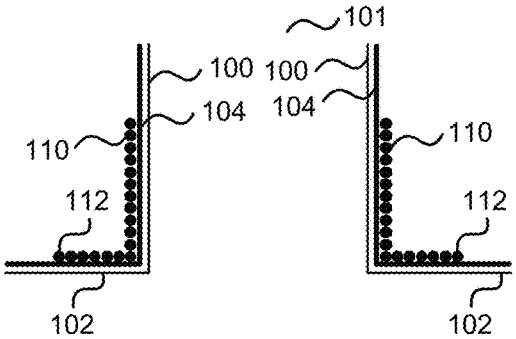
FIG. 1D illustrates an antenna arrangement in accordance with another embodiment.

FIG. 1D illustrates an antenna arrangement in accordance with another embodiment. The antenna arrangement illustrated in FIG. 1D differs from the antenna arrangement illustrated in FIG. 1B in that the magnetic loop antenna coil 110, 112 does not completely extend to cover the magnetic material layer 104.

Figure 1E:
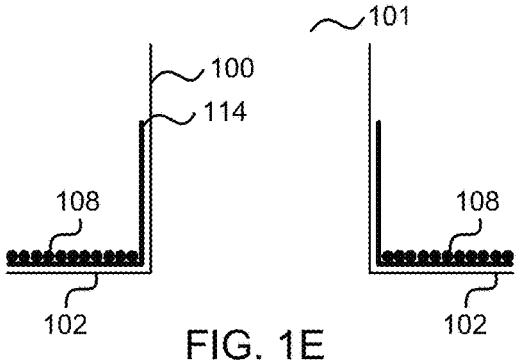
FIG. 1E illustrates an antenna arrangement in accordance with another embodiment.

FIG. 1E illustrates an antenna arrangement in accordance with another embodiment. The antenna arrangement illustrated in FIG. 1E differs from the antenna arrangement illustrated in FIG. 1C in that the magnetic material layer 114 covers the flange 102 completely but only a part of the collar 100. In some embodiments there might be some mechanical conflicts that do not allow the magnetic loop antenna coil 108 to be wrapped all the way to the top of the collar 100. In this case, when including the antenna arrangement to a mobile device having a back cover having an opening in the vicinity of the antenna arrangement, and when extending the magnetic material layer towards the opening in the back cover, a better control the magnetic field flow is provided.

Figure 1F:
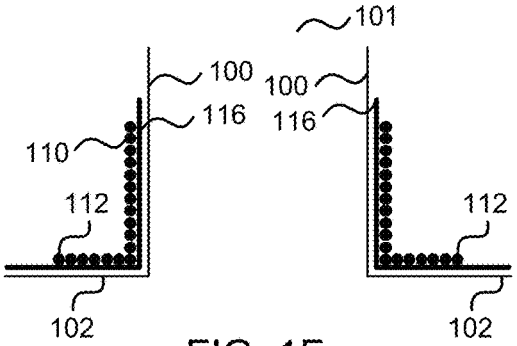
FIG. 1F illustrates an antenna arrangement in accordance with another embodiment.

FIG. 1F illustrates an antenna arrangement in accordance with another embodiment. The antenna arrangement illustrated in FIG. 1F differs from the antenna arrangement illustrated in FIG. 1D in that the magnetic material layer 116 covers the flange 102 completely but only a part of the collar 100.

Figure 1G:
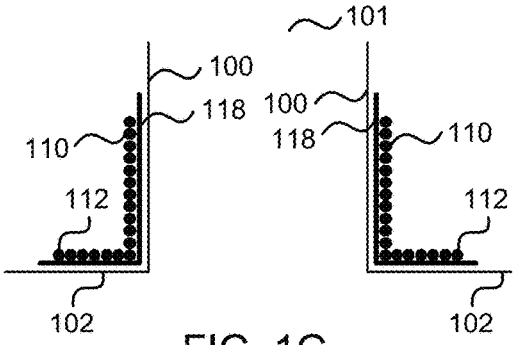
FIG. 1G illustrates an antenna arrangement in accordance with another embodiment.

FIG. 1G illustrates an antenna arrangement in accordance with another embodiment. The antenna arrangement illustrated in FIG. 1G differs from the antenna arrangement illustrated in FIG. 1F in that the magnetic material layer 118 covers both the flange 102 and the collar 100 only partly.

Figure 1H:
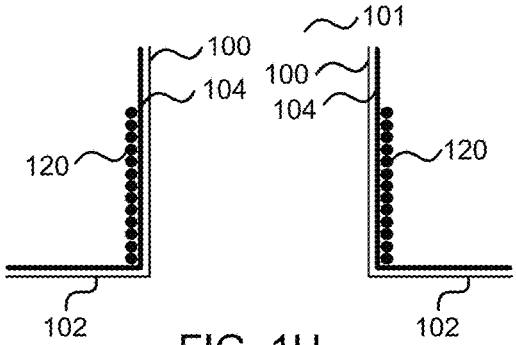
FIG. 1H illustrates an antenna arrangement in accordance with another embodiment.

FIG. 1H illustrates an antenna arrangement in accordance with another embodiment. The antenna arrangement illustrated in FIG. 1H differs from the antenna arrangement illustrated in FIG. 1A in that the magnetic loop antenna coil 120 does not completely cover the magnetic material layer 104 on the collar 100.

In any of FIGS. 1B, 1C, 1D, 1E, 1F and 1G, when the coil 106, 110 extends 108, 112 to cover also the flange 102 of the casing 101, the effective area of the coil increases. Due to this, coupling to some larger coils can improve because magnetic near field coupling between two loop antennas is optimized then the initiator coil and the target coil have similar form factors (size and shape). The number of coil turns may also affect the coupling.

Further, when a mobile device comprising a metallic back cover comprises the antenna arrangement illustrated in any of FIGS. 1B, 1C, 1D, 1E, 1F and 1G, and if the antenna arrangement is located close to the edge of the metallic back cover, extending the coil edge towards the back cover edge may help to extend the magnetic fields outside of the casing 101. This means that the operating volume may be extended.

In one embodiment of any of FIGS. 1A-1H, the antenna arrangement is implemented in a mobile device having a metallic back cover. The collar 100 may not be physically connected to the metallic back cover. In another embodiment, the collar 100 is physically connected to the metallic back cover and the collar 100 can be grounded to the back cover.

Figure 2A:
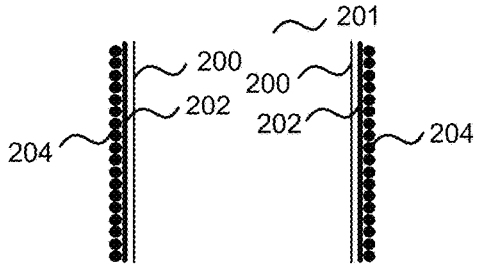
FIG. 2A illustrates an antenna arrangement in accordance with another embodiment.

FIG. 2A illustrates an antenna arrangement in accordance with another embodiment. Compared to the embodiment illustrated in FIG. 1A, in FIG. 2A the casing 201 comprises only a collar 200, in other words, the part that extends upwards. Again, although in FIG. 2A the collar 200 extends vertically upwards compared to a horizontal place, in other embodiments, the angle between the collar 200 and the horizontal plane may be different than 90 degrees. For simplicity, FIG. 2A may not illustrate all parts or surfaces belonging to the casing 201, for example, a top surface.

As in the embodiment illustrated in FIG. 1A, the casing 201 illustrated in FIG. 2A may be a mechanical holder of an existing element in a mobile device. For example, the casing 201 may be a camera holder surrounding a camera. In another embodiment, the casing 201 may be a supporting element for a fingerprint reader or a flash module.

In FIG. 2A, a magnetic material layer 202 has been arranged to completely cover an outer surface of the collar 200. The magnetic material layer 202 may be applied on the collar 200 using any appropriate technique, for example, gluing, molding, casting, painting etc. Further, although FIG. 2A may illustrate that the magnetic material layer 104 resides on the outer surface of the collar 200, in another embodiment the magnetic material layer may not be in direct contact with the outer surface of the collar 200.

The antenna arrangement comprises also a magnetic loop antenna coil 204 covering the collar 200 so that the magnetic material layer 202 is between the magnetic loop antenna coil 204 and the outer surface of the collar 200. In one embodiment, the magnetic loop antenna coil 204 is wrapped on the top of the magnetic material layer 204 around the collar 204. The number of rounds of the magnetic loop antenna coil 204 around the collar 200 may depend on the purpose of use of the antenna arrangement and the frequency range provided by the antenna. Although not illustrated in FIG. 2A, the magnetic loop antenna coil 204 may have connection ends to connect the magnetic loop antenna coil 204, for example, to a matching circuit.

The magnetic material layer 204 may comprise ferrite. It is also possible to use other material than ferrite as long as the material favorably aligns the magnetic flux provided by the magnetic loop antenna coil 204 and shields possible metal parts of the casing 201 from the magnetic field of the antenna.

The casing 201 may be made of electrically conductive or non-conductive material.

Figure 2B:
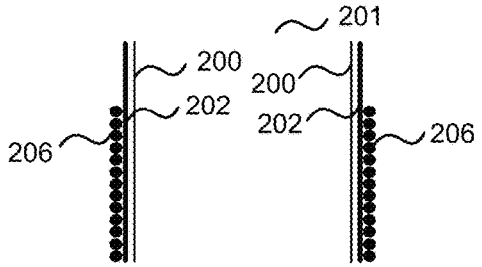
FIG. 2B illustrates an antenna arrangement in accordance with another embodiment.

FIG. 2B illustrates an antenna arrangement in accordance with another embodiment. The antenna arrangement illustrated in FIG. 2B differs from the antenna arrangement illustrated in FIG. 2A in that the magnetic loop antenna coil 206 only partly covers the magnetic material layer 202 and the collar 200.

Figure 2C:
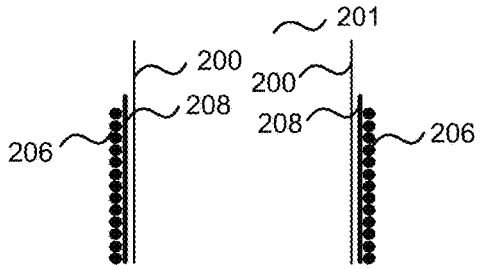
FIG. 2C illustrates an antenna arrangement in accordance with another embodiment.

FIG. 2C illustrates an antenna arrangement in accordance with another embodiment. The antenna arrangement illustrated in FIG. 2C differs from the antenna arrangement illustrated in FIG. 2B in that also the magnetic material layer 208 only partly covers the collar 200.

An antenna arranged illustrated in any of FIG. 1A-1G or FIG. 2A-2C may be manufactured by first applying the magnetic material layer on the outer surface of the casing 201, for example, by gluing, molding, casting or painting. The magnetic loop antenna coil may be wrapped around the casing 201.

Figure 3A:
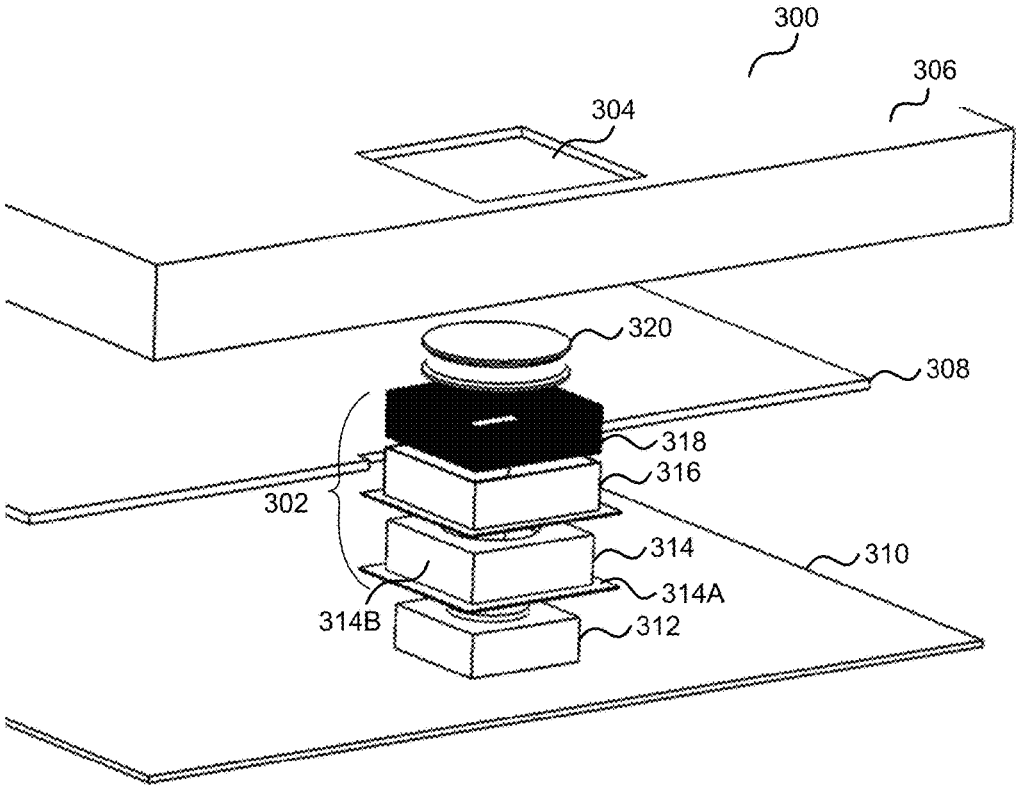
FIG. 3A illustrates a mobile apparatus comprising an antenna arrangement.

FIG. 3A illustrates a mobile apparatus 300 comprising an antenna arrangement 302. For simplicity, only some of the elements included in the mobile apparatus 300 are shown in FIG. 3A.

The mobile apparatus 300 comprises a display and a display support 310. In the embodiment illustrated in FIG. 3A a camera arrangement is fixedly attached to the display and the display support 310. Normally the camera arrangement would include a camera module 312, a camera holder 314 and camera lenses 320. The camera holder 314 keeps the camera module in a fixed position on the display and display support 310.

In addition to the normal camera arrangement element, the camera arrangement comprises elements that provide antenna capabilities for the mobile apparatus 300. The antenna arrangement 302 makes use of an existing component already present in the mobile apparatus 300. Outer surfaces 314A, 314B of the camera holder 314 have been covered with a magnetic material layer. For illustration purposes, the magnetic material layer is illustrated in FIG. 3A as a separate element 316. A magnetic loop antenna coil 318 has been arranged around the camera holder 314 on top of the magnetic material layer 316. The magnetic loop antenna coil 316 comprises also connecting ends to be connected, for example, to a matching circuit. For simplicity, the connecting ends are not shown in FIG. 3A.

A printed wiring board (PWB) 308 may include one or more additional components (for example, the matching circuit) needed to operate the magnetic loop antenna coil 318. An opening 304 in a back cover 306 of the mobile apparatus 300 is adapted for the camera lenses 302. In one embodiment, the back cover 306 is a metallic back cover. In another embodiment, the back cover 306 is partly of wholly made of other material or materials, for example, plastic.

If the antenna arrangement 302 is used for wireless charging purposes and the back cover 306 of the mobile apparatus 300 is made of metal, the opening 304 in the back cover 306 provides an opening for the magnetic field produced with the magnetic loop antenna coil to extend outside the back cover 306.

Figure 3B:
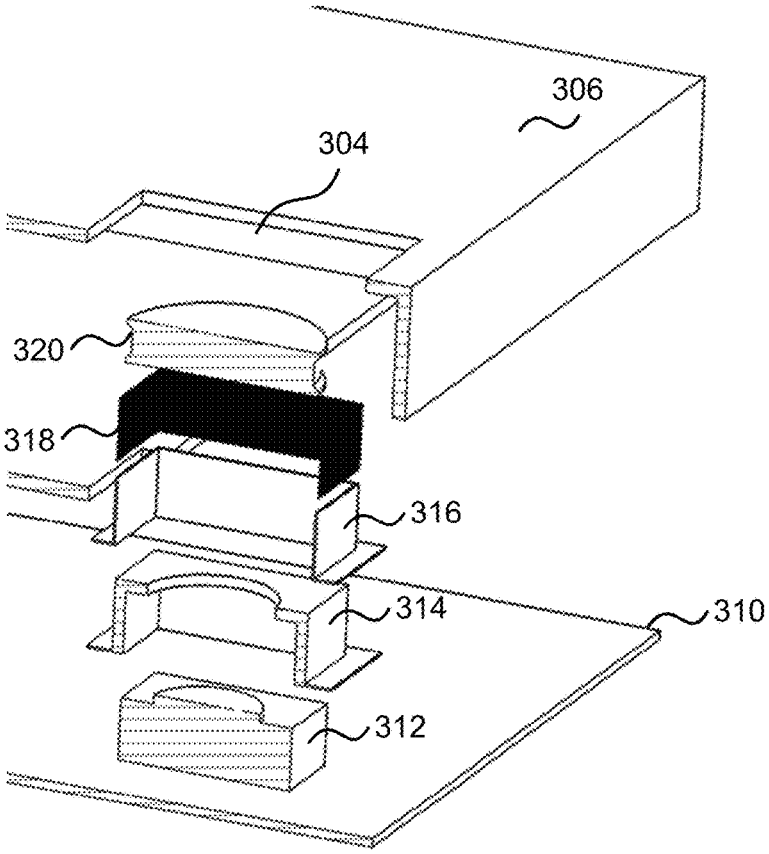
FIG. 3B illustrates a cross section of the elements 312, 314, 315, 318 and 320 illustrated in FIG. 3A.

FIG. 3B illustrates a cross section of the elements 312, 314, 315, 318 and 320 already illustrated in FIG. 3A.

In one embodiment of FIGS. 3A and 3B, the camera holder 316 is not physically connected to the back cover 306. In another embodiment, the camera holder 316 may be physically connected to the back cover 306. Thus the camera holder 316 can be grounded to the back cover.

Figure 4A:
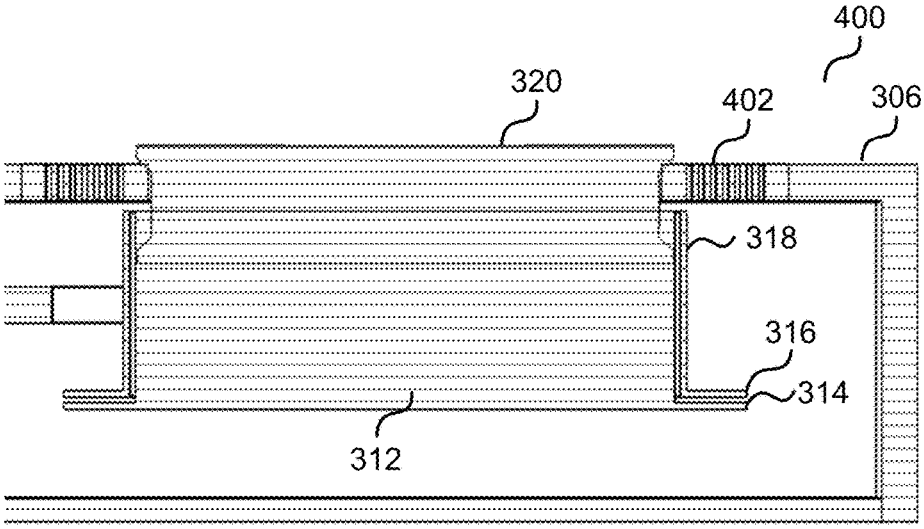
FIG. 4A illustrates a mobile apparatus comprising an antenna arrangement.

FIG. 4A illustrates a mobile apparatus 400 comprising an antenna arrangement. The antenna arrangement makes use of an existing component already present in the mobile apparatus 400. Outer surfaces of a camera holder 314 have been covered with a magnetic material layer 316. A magnetic loop antenna coil 318 has been arranged around the camera holder 314 on top of the magnetic material layer 316. The magnetic loop antenna coil 316 may comprise also connecting ends to be connected, for example, to a matching circuit. For simplicity, the connecting ends are not shown in FIG. 4A. A back cover 306 of the mobile apparatus 400 comprises an opening or aperture through which camera lenses 320 are able to operate. If the back cover 306 is made of metal and if the opening or aperture in the back cover 306 is large enough, there may not be need to arrange any additional openings in the back cover 306 for the magnetic field to go through.

Figure 4B:
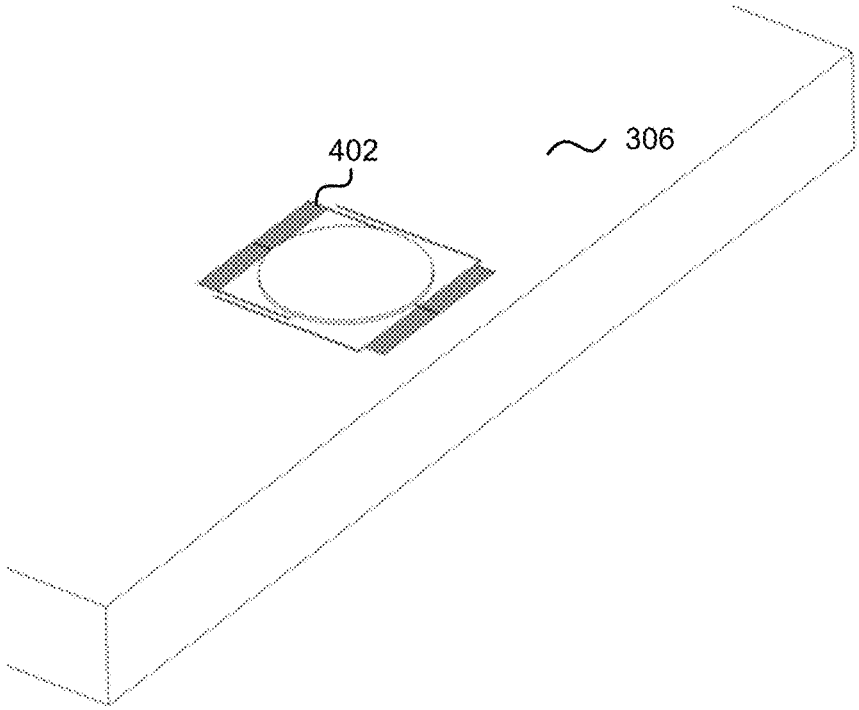
FIG. 4B illustrates the openings in the back cover of the mobile apparatus in more detail.
Figure 4C:
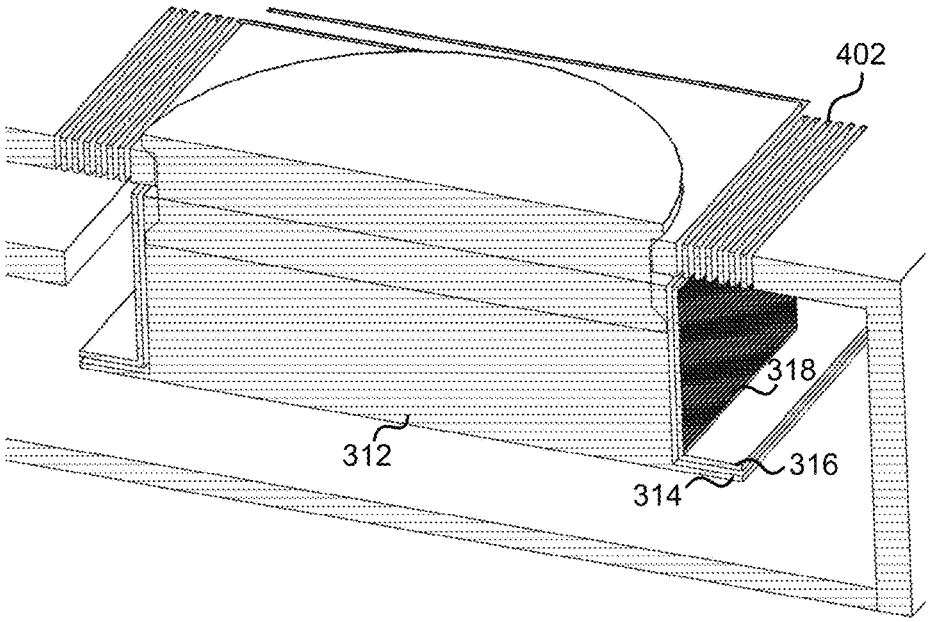
FIG. 4C illustrates the openings in the back cover of the mobile apparatus in more detail.

However, in order to enable more efficient magnetic field flow through the back cover 306, the back cover 306 may comprise one or more additional openings or slots 402. The openings or slots 402 are illustrated in more detail in FIGS. 4B and 4C. The form or pattern of the openings or slots 402 may take any appropriate form or pattern and they can be made using, for example, micro-lasering to hide the visual slots.

Figure 5A:
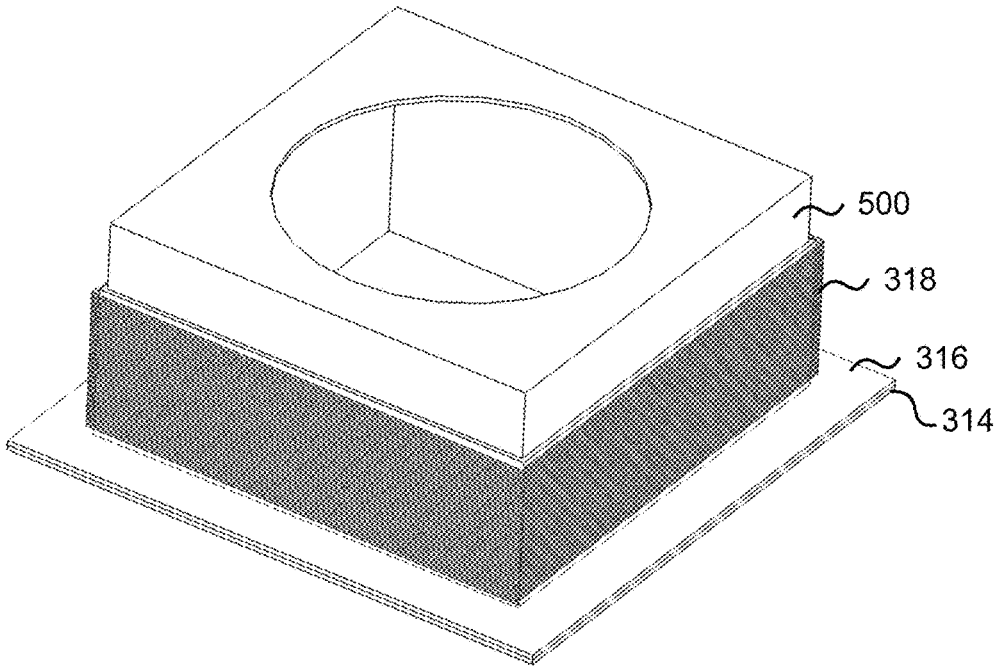
FIG. 5A illustrates another view of an antenna arrangement.

FIG. 5A illustrates another view of an antenna arrangement. The embodiment of FIG. 5A is similar to the embodiment illustrated in FIG. 1D with the exception that the magnetic loop antenna coil 318 resides only on the vertical outer surface of the camera holder 314 and not at all on the horizontal outer surface of the camera holder 314.

An outer surface of the upper part 500 of the camera holder is not covered by the magnetic material 316 and the magnetic loop antenna coil 318, as illustrated in FIG. 5A. If the camera holder 314 is made on a non-conductive material, there are no eddy currents that would cancel the magnetic field produced by the magnetic loop antenna coil 318.

Figure 5B:
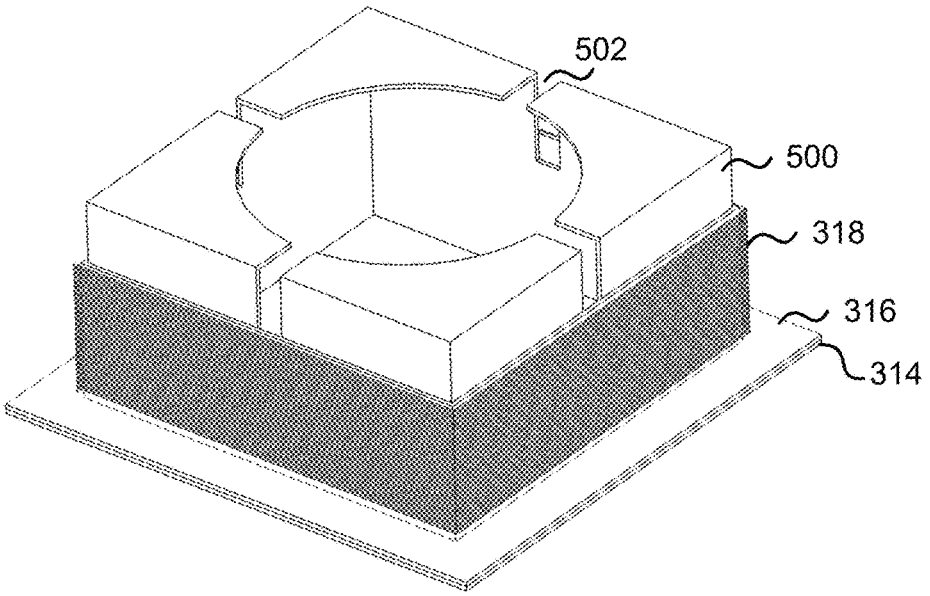
FIG. 5B illustrates another view of an antenna arrangement.

FIG. 5B illustrates another view of an antenna arrangement. The antenna arranged is similar to the antenna arrangement illustrated in FIG. 5A with the exception that the camera holder 314 comprise one or more slits 502 on the side and top surfaces. If the camera holder 314 is made of conducting material eddy currents would be generated to the surface of the camera holder 314 not covered by the magnetic material layer 318. However, the slits 502 in the camera holder 314 cancel at least part of the disturbing eddy currents.

Figure 6A:
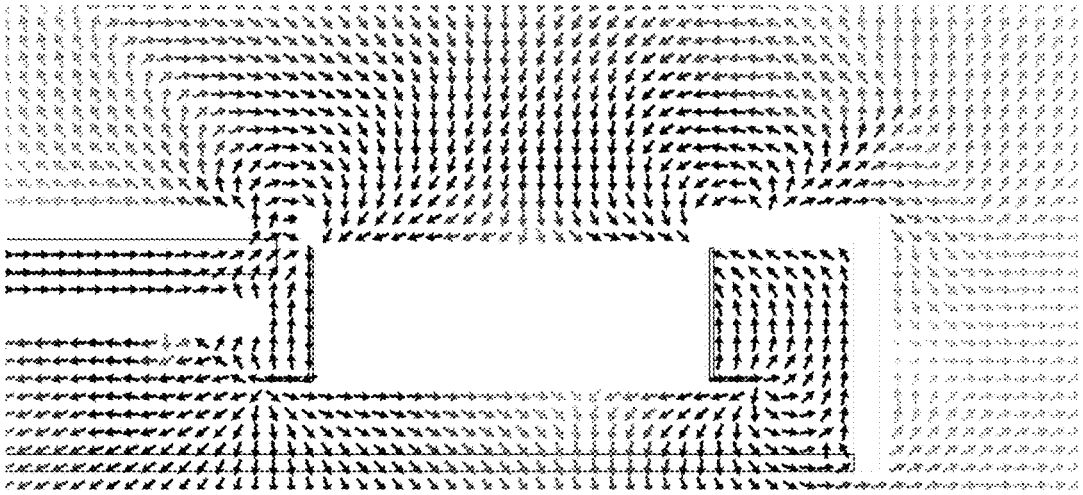
FIG. 6A illustrates the magnetic field produced by the magnetic loop antenna coil illustrated in FIG. 3A in a cut plane.

FIG. 6A illustrates the magnetic field produced by the magnetic loop antenna coil 318 illustrated in FIG. 3A in a cut plane. As can be seen from FIG. 6A, there is return path for the magnetic field at the surface of the magnetic material layer, for example, a ferrite layer.

Figure 6B:
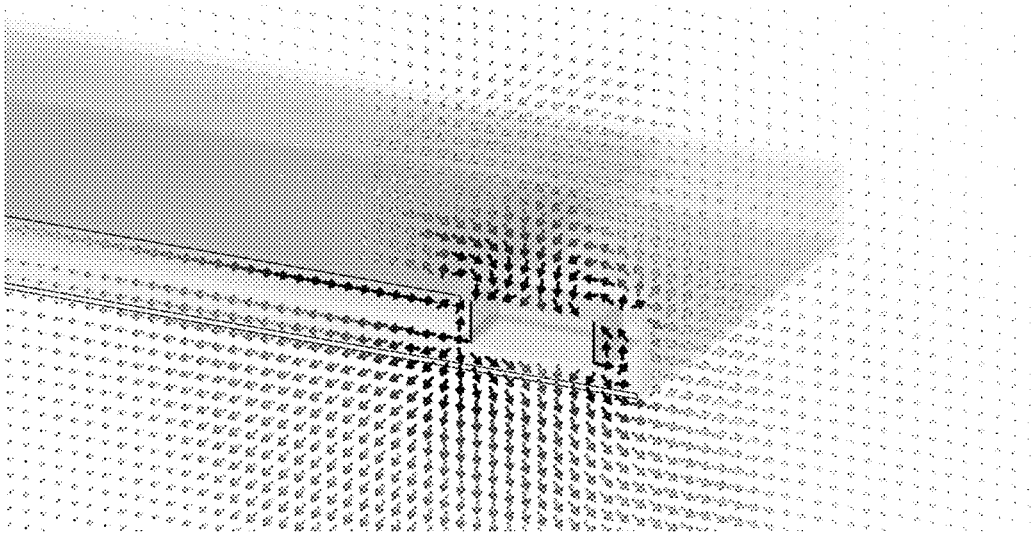
FIG. 6B illustrates another embodiment of the magnetic field produced by the magnetic loop antenna coil illustrated in FIG. 3A in a cut plane.

FIG. 6B illustrates another embodiment of the magnetic field produced by the magnetic loop antenna coil 318 illustrated in FIG. 3A in a cut plane.

Figure 6C:
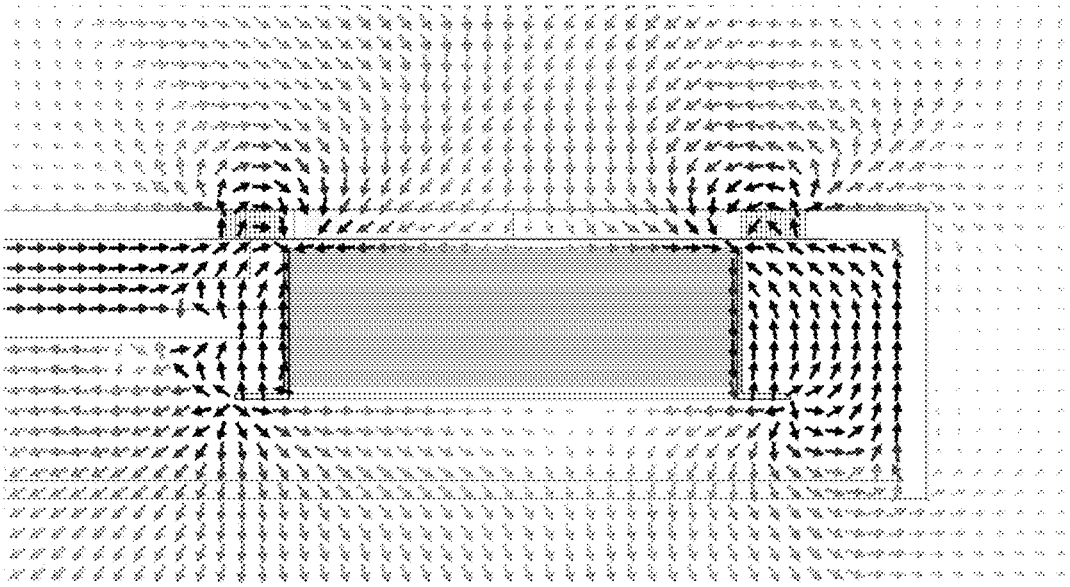
FIG. 6C illustrates the magnetic field produced by the magnetic loop antenna coil illustrated in FIG. 3A in a cut plane in a case where the back cover of the mobile apparatus comprises at least one opening.

FIG. 6C illustrates the magnetic field produced by the magnetic loop antenna coil 318 illustrated in FIG. 3A in a cut plane in a case where the back cover 306 of the mobile apparatus comprises at least one opening 402. As can be seen from FIG. 6C, the magnetic field flows through the openings 402 in the back cover of the mobile apparatus. This enables that the magnetic field can flow freely through the back cover. Another effect of the use of the openings 402 is that they introduce resistance for eddy currents. This is due to the fact that eddy currents are forced to flow a longer path along the conducting material because of the slots.

Figure 7:
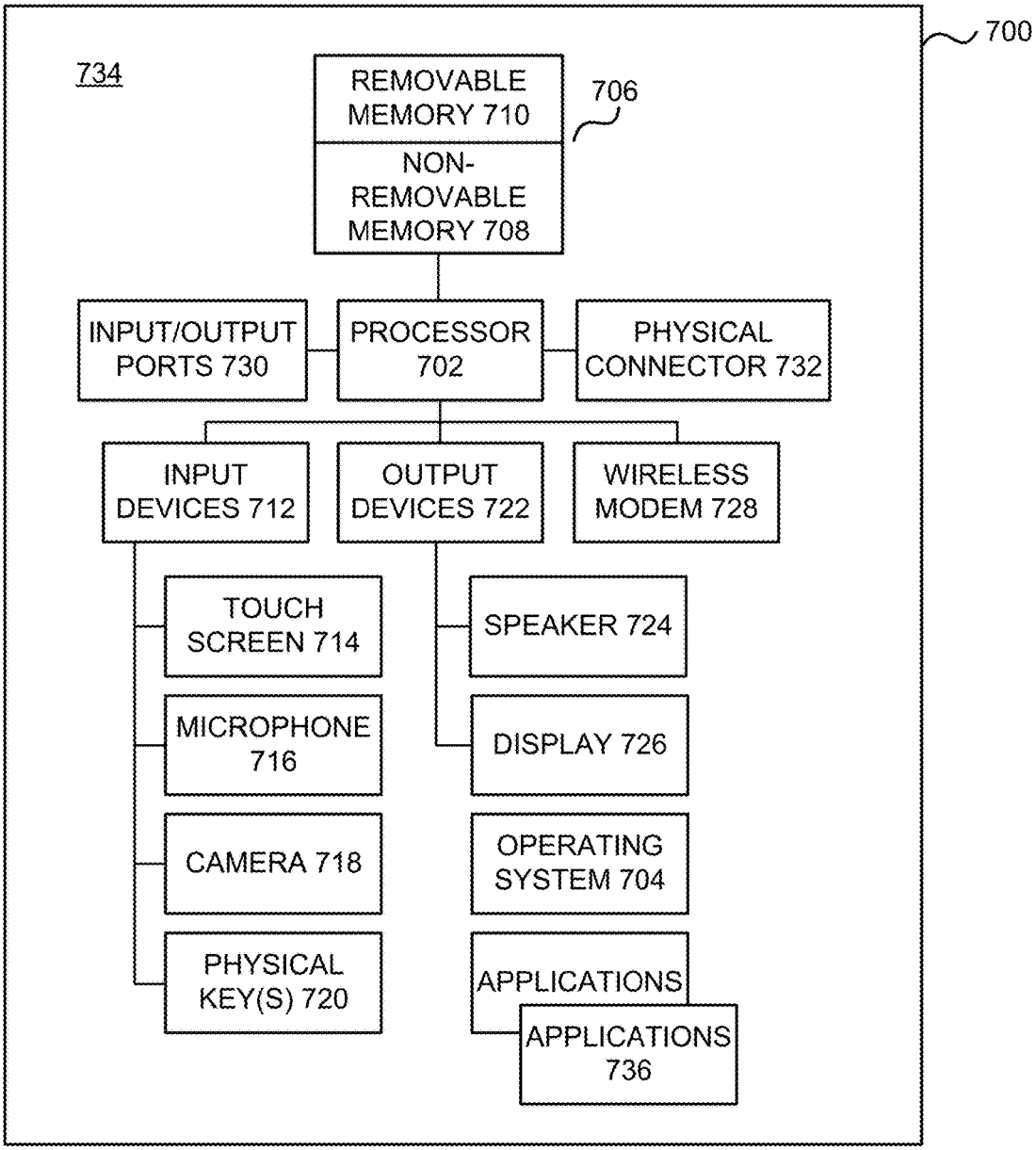
FIG. 7 is a system diagram depicting a mobile apparatus including a variety of optional hardware and software components.

FIG. 7 is a system diagram depicting a mobile apparatus 700 including a variety of optional hardware and software components, shown generally at 734. Any components 734 in the mobile apparatus may communicate with any other component, although not all connections are shown, for ease of illustration. The apparatus may be any of a variety of computing devices (for example, a smart phone, a tablet computer, a smart watch etc.) and may allow wireless two-way communications with one or more communications networks, such as a data, cellular or satellite network.

The illustrated apparatus 700 comprises a controller or processor 702 (e.g., signal processor, microprocessor, ASIC, or other control and processing logic circuitry) for performing such tasks as signal coding, data processing, input/output processing, power control, and/or other functions. An operating system 704 controls the allocation and usage of the components 734 and supports for one or more application programs 736. The application programs can include computing applications (e.g., an application preparing meeting minutes, messaging applications), or any other computing application.

The illustrated mobile apparatus 700 comprises a memory 706. The memory 106 may include non-removable memory 708 and/or removable memory 710. The non-removable memory 708 may include RAM, ROM, flash memory, a hard disk, or other well-known memory storage technologies. The removable memory 710 may include, for example, a flash memory, or other well-known memory storage technologies, such as "smart cards". The memory 706 may be used for storing data and/or code for running the operating system 704 and the applications 136. Example data may include sound files, video data, or other data sets to be sent to and/or received from one or more network servers or other devices via one or more wired or wireless networks.

The mobile apparatus 700 supports one or more input devices 712, such as a touchscreen 714, microphone 716, camera 718 and/or physical keys or a keyboard 720 and one or more output devices 722, such as a speaker 724 and a display 726. Some devices can serve more than one input/output function. For example, the touchscreen 714 and the display 726 can be combined in a single input/output device. The input devices 712 can include a Natural User Interface (NUI). An NUI is any interface technology that enables a user to interact with a device in a "natural" manner, free from artificial constraints imposed by input devices such as mice, keyboards, remote controls, and the like. Examples of NUI methods include those relying on speech recognition, touch and stylus recognition, gesture recognition both on screen and adjacent to the screen, air gestures, head and eye tracking, voice and speech, vision, touch, gestures, and machine intelligence. Other examples of a NUI include motion gesture detection using accelerometers/gyroscopes, facial recognition, 3D displays, head, eye, and gaze tracking, immersive augmented reality and virtual reality systems, all of which provide a more natural interface, as well as technologies for sensing brain activity using electric field sensing electrodes (EEG and related methods). Thus, in one specific example, the operating system 704 or applications 736 may comprise speech-recognition software as part of a voice user interface that allows a user to operate the mobile apparatus 700 via voice commands. Further, the mobile apparatus 700 may comprise input devices and software that allows for user interaction via a user's spatial gestures, such as detecting and interpreting gestures to provide input to a gaming application.

A wireless modem 728 may be coupled to an antenna (not shown) or antenna arrangement and can support two-way communications between the processor 702 and external devices, as is well understood in the art. The modem 728 is shown generically and may include a cellular modem for communicating with a mobile communication network and/or other radio-based modems (e.g., BLUETOOTH or Wi-Fi). The antenna arrangement may comprise a magnetic loop antenna coil comprising an antenna for wireless charging, near field communication, or a frequency modulation/amplitude modulation radio. The antenna arrangement may be integrated in a module, element or device element holder, as illustrated, for example, in any of FIGS. 1A-1H.

The mobile apparatus 700 may further include at least one input/output port 730, and/or a physical connector 732, which can be an Ethernet port, a Universal Serial Bus (USB) port, Institute of Electrical and Electronics Engineers (IEEE) 1394 (FireWire) port, and/or Recommended Standard (RS) 232 port. The illustrated components 734 are not required or all-inclusive, as any components can deleted and other components can be added.

Any combination of the following embodiments or aspects is within the scope of the invention.

According to an aspect, there is provided an antenna arrangement comprising a casing comprising a flange and a collar extending upwards from the flange, a magnetic loop antenna coil covering an outer surface of at least one of the flange and the collar at least partly, and a magnetic material layer between the magnetic loop antenna coil and the outer surface of the flange and the collar to guide the magnetic flux generated by the magnetic loop antenna coil, the magnetic material layer covering both the flange and the collar at least partly.

In one embodiment, the magnetic material layer completely covers the outer surface of the flange and the collar.

In one embodiment, the magnetic loop antenna coil completely covers the outer surface of the flange.

In one embodiment, the magnetic loop antenna coil completely covers the outer surface of the collar.

In one embodiment, the magnetic loop antenna coil covers only the outer surface of the collar at least partly.

In one embodiment, the magnetic loop antenna coil covers only the outer surface of the flange at least partly.

In one embodiment, the magnetic loop antenna coil covers both the flange and the collar at least partly.

In one embodiment, alternatively or in addition, the collar comprises at least one slit at least partly in the section of the collar not covered by the magnetic antenna loop coil and the magnetic material layer.

In one embodiment, alternatively or in addition, the magnetic material layer is in contact with the outer surface of the flange and the collar.

In one embodiment, alternatively or in addition, the magnetic material layer is glued, molded, casted or painted on the outer surface of the flange and the collar.

In one embodiment, alternatively or in addition, the magnetic loop antenna coil comprises an antenna for wireless charging, near field communication, or a frequency modulation/amplitude modulation radio.

In one embodiment, alternatively or in addition, the magnetic material layer comprises ferrite.

In one embodiment, alternatively or in addition, the casing comprises one of a camera module holder, a camera flash holder, and a fingerprint reader holder.

According to another aspect, there is provided an antenna arrangement comprising a casing comprising a collar extending upwards, a magnetic loop antenna coil covering an outer surface of the collar at least partly, and a magnetic material layer between the magnetic loop antenna coil and the outer surface of the collar to guide the magnetic flux generated by the magnetic loop antenna coil.

In one embodiment, the magnetic material layer completely covers the outer surface of the collar.

In one embodiment, the magnetic loop antenna coil material layer completely covers the outer surface of the collar.

In one embodiment, alternatively or in addition, the collar comprises at least one slit at least partly in the section of the collar not covered by the magnetic antenna loop coil and the magnetic material layer.

In one embodiment, alternatively or in addition, the magnetic material layer is in contact with the outer surface of the collar.

In one embodiment, alternatively or in addition, the magnetic material layer is glued, molded, casted or painted on the outer surface of the collar.

In one embodiment, alternatively or in addition, the magnetic loop antenna coil comprises an antenna for wireless charging, near field communication, or a frequency modulation/amplitude modulation radio.

In one embodiment, alternatively or in addition, the magnetic material layer comprises ferrite.

In one embodiment, alternatively or in addition, the casing comprises one of a camera module holder, a camera flash holder, and a fingerprint reader holder.

According to another aspect, there is provided a mobile apparatus comprising a metallic back cover comprising an opening and a mobile apparatus component casing. The mobile apparatus component casing comprises a flange and a collar extending upwards from the flange towards the metallic back cover, a magnetic loop antenna coil covering an outer surface of at least one of the flange and the collar at least partly, and a magnetic material layer between the magnetic loop antenna coil and the outer surface of the flange and the collar to guide the magnetic flux generated by the magnetic loop antenna coil towards the opening, the magnetic material layer covering both the collar and the flange at least partly.

In one embodiment, the metallic back cover comprises at least one additional slot in the vicinity of the opening enabling the magnetic flux to go through the metallic back cover.

In one embodiment, the mobile apparatus component casing comprises one of a camera module holder, a camera flash holder, and a fingerprint reader holder.

Alternatively, or in addition, the functionally described herein can be performed, at least in part, by one or more hardware logic components. For example, and without limitation, illustrative types of hardware logic components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), etc.

Any range or device value given herein may be extended or altered without losing the effect sought.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages.

Aspects or features of any of the examples described above may be combined with aspects of any of the other examples described to form further examples without losing the effect sought.

The term 'comprising' is used herein to mean including the method blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification. In particular, the individual features, elements, or parts described in the context of one example, may be connected in any combination to any other example also.

The invention claimed is:

1. An antenna arrangement comprising:

a casing comprising a flange and a collar extending upwards from the flange;

a magnetic loop antenna coil covering an outer surface of at least one of the flange and the collar at least partly; and a magnetic material layer between the magnetic loop antenna coil and the outer surface of the flange and the collar to guide the magnetic flux generated by the magnetic loop antenna coil towards an opening, the magnetic material layer covering both the flange and the collar at least partly, wherein the collar comprises at least one slit at least partly in a section of the collar not covered by the magnetic antenna loop coil and the magnetic material layer.

2. An antenna arrangement according to claim 1, wherein the magnetic material layer completely covers the outer surface of the flange and the collar.

3. An antenna arrangement according to claim 1, wherein the magnetic loop antenna coil completely covers the outer surface of the flange.

4. An antenna arrangement according to claim 1, wherein the magnetic loop antenna coil completely covers the outer surface of the collar.

5. An antenna arrangement according to claim 1, wherein the magnetic loop antenna coil covers only the outer surface of the collar at least partly.

6. An antenna arrangement according to claim 1, wherein the magnetic loop antenna coil covers only the outer surface of the flange at least partly.

7. An antenna arrangement according to claim 1, wherein the magnetic loop antenna coil covers both the flange and the collar at least partly.

8. An antenna arrangement according to claim 1, wherein the magnetic material layer is in contact with the outer surface of the flange and the collar.

9. An antenna arrangement according to claim 1, wherein the magnetic material layer is glued, molded, casted or painted on the outer surface of the flange and the collar.

10. An antenna arrangement according to claim 1, wherein the magnetic loop antenna coil comprises an antenna for wireless charging, near field communication, or a frequency modulation/amplitude modulation radio.

11. An antenna arrangement according to claim 1, wherein the magnetic material layer comprises ferrite.

12. An antenna arrangement according to claim 1, wherein the casing comprises one of a camera module holder, a camera flash holder, and a fingerprint reader holder.

13. An antenna arrangement according to claim 1, wherein the at least one slit is configured to cancel out eddy currents.

14. An antenna arrangement comprising:

a casing comprising a collar extending upwards;

a magnetic loop antenna coil covering an outer surface of the collar at least partly; and a magnetic material layer between the magnetic loop antenna coil and the outer surface of the collar to guide the magnetic flux generated by the magnetic loop antenna coil towards an opening, wherein the collar comprises at least one slit at least partly in a section of the collar not covered by the magnetic antenna loop coil and the magnetic material layer.

15. An antenna arrangement according to claim 14, wherein the magnetic material layer completely covers the outer surface of the collar.

16. An antenna arrangement according to claim 14, wherein the magnetic loop antenna coil completely covers the outer surface of the collar.

17. An antenna arrangement according to claim 14, wherein the magnetic loop antenna coil comprises an antenna for wireless charging, near field communication, or a frequency modulation/amplitude modulation radio.

18. A mobile apparatus comprising:

a metallic back cover comprising an opening;

a mobile apparatus component casing comprising a flange and a collar extending upwards from the flange towards the metallic back cover;

a magnetic loop antenna coil covering an outer surface of at least one of the flange and the collar at least partly; and a magnetic material layer between the magnetic loop antenna coil and the outer surface of the flange and the collar to guide the magnetic flux generated by the magnetic loop antenna coil towards the opening, the magnetic material layer covering both the collar and the flange at least partly, wherein the collar comprises at least one slit at least partly in a section of the collar not covered by the magnetic antenna loop coil and the magnetic material layer.

19. A mobile apparatus according to claim 18, wherein the metallic back cover comprises at least one additional opening in the vicinity of the opening enabling the magnetic flux to go through the metallic back cover.

20. A mobile apparatus according to claim 18, wherein the casing comprises one of a camera module holder, a camera flash holder, and a fingerprint reader holder.

* * * * *